US006099267A

United States Patent [19]

Ames et al.

[11] Patent Number: 6,099,267

[45] Date of Patent: Aug. 8, 2000

[54] STAND FOR A FLUID COMPRESSOR HAVING AN EXTENDING AND ROTATING MOVABLE STARTER BOX BASE PLATE

[75] Inventors: Mark J. Ames; Craig W. Haddock, both of Mooresville, N.C.

[73] Assignee: Ingersoll-Rand Company, Woodcliff Lake, N.J.

[21] Appl. No.: 09/074,889

[22] Filed: May 8, 1998

[51] Int. Cl.[7] ..... F04B 17/00

[52] U.S. Cl. ..... 417/360; 417/53; 417/236; 248/676; 248/346.07

[58] Field of Search ..... 417/53, 360, 236, 417/313; 248/676, 346.07

[56] References Cited

U.S. PATENT DOCUMENTS

| | | | |
|---|---|---|---|
| 1,713,946 | 5/1929 | Buckley | 248/346.07 |
| 2,594,688 | 4/1952 | Shapiro | 248/346.07 |
| 2,764,948 | 10/1956 | Jones | 103/218 |
| 2,798,660 | 7/1957 | Flynn | 230/117 |
| 3,209,374 | 10/1965 | Waltz | 248/346.07 |
| 3,503,577 | 3/1970 | Martin | 248/346.07 |
| 4,092,088 | 5/1978 | Nemesi | 417/360 |
| 4,123,038 | 10/1978 | Meyers | 254/2 R |
| 4,512,543 | 4/1985 | Petrick | 248/670 |
| 4,977,750 | 12/1990 | Metcalfe | 62/77 |
| 5,040,953 | 8/1991 | Tinsler | 417/363 |
| 5,085,396 | 2/1992 | Mansson | 248/678 |
| 5,203,680 | 4/1993 | Waldrop | 417/364 |
| 5,497,816 | 3/1996 | Darland | 144/287 |
| 5,533,874 | 7/1996 | Hauser | 417/360 |
| 5,582,026 | 12/1996 | Barto | 62/298 |
| 5,613,843 | 3/1997 | Tsuru et al. | 417/313 |

*Primary Examiner*—Charles G. Freay
*Assistant Examiner*—Robert Z. Evora
*Attorney, Agent, or Firm*—Foley & Lardner

[57] ABSTRACT

A fluid compressor that includes a compressor base; a compression module fixed to the base; and a compressor control device, such as a compressor starter box, fixed to the base; where the compressor base includes means for moving the compressor starter box toward and away from the compression module while the compressor starter box is attached to the base.

9 Claims, 7 Drawing Sheets

STAND FOR A FLUID COMPRESSOR HAVING AN EXTENDING AND ROTATING MOVABLE STARTER BOX BASE PLATE

BACKGROUND OF THE INVENTION

The invention generally relates to a fluid compressor having a starter box that is attached to a compressor base, and more particularly, the invention relates to a fluid compressor with a starter box that is attached to the compressor base and is movable relative to the compressor base.

Conventional fluid compressors generally include a compression module or airend that is driven by a prime mover, such as an electric motor; a separator tank for separating liquid from the compressed fluid, such as air; a heat exchanger or aftercooler for cooling the hot compressed fluid; and an electrically actuated cooling fan for supplying ambient fluid or air to the compressor and the heat exchanger. The airend and prime mover are fixed to the center of a compressor support frame or base and the separator tank and heat exchanger are also fixed to the frame adjacent to the airend and prime mover.

The various compressor components are flow connected by the required piping, and the flow of compressed fluid through the compressor airend and piping is controlled by conventional valves such as electronic solenoid valves.

Additionally, such known compressors also include a compressor starter box that is fixed to the frame. The compressor starter box houses the electronic components that control operation of compressor components. Such electrical components may include contacts and relays for starting and stopping the prime mover and cooling fan and for opening and closing the solenoid valves. The compressor starter box also may house the microprocessor based compressor controller for monitoring compressor performance parameters to determine if the compressor is operating as required. The compressor starter box is fixed to the compressor base by a plurality of bolts or other conventional connection members so that the starter box is not movable relative to the compressor base.

The compressor base of conventional design has a rectangular perimeter with one side of the frame designated as the frame front side. When the compressor is located in its operating environment, frequently, the rear side of the frame is located proximate a wall, and the frame sides joining the front and rear frame sides are adjacent other compressors or machines. As a result, the front side of the frame is the only frame side that is accessible by a compressor operator or technician.

After a period of compressor use, a compressor technician must service and/or repair the airend and prime mover. In order for a compressor technician to make the required repairs or provide the required maintenance, the airend and prime mover must be removed from the compressor base. Because the front side of the compressor is the only easily accessible compressor frame side, the airend and prime mover are taken out of the compressor through the compressor front side. In order to remove the airend and prime mover through the front of the compressor, the compressor starter box connections must be loosened and removed, and the starter box is lifted from the base by a small crane with another technician guiding the compressor starter box off and away from the frame to ensure the heavy starter box does not contact and damage other compressor components, valves, or piping. Also, before removing the starter box, the many electrical connections to the box between the housed electrical components and the controlled compressor components must be disconnected. Once the starter box has been removed from the base, the airend and prime mover can then be removed through the front of the compressor base.

In conventional compressors, it is difficult to provide the required service and repairs to the prime mover and airend. A number of technicians are required to remove the starter box in order to be able to remove the airend and prime mover from the compressor base. Since removing the compressor prime mover and airend is difficult, the required service is frequently not performed, the airend and prime mover are damaged and will have a shorter useful life.

The foregoing illustrates limitations known to exist in present fluid compressor designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid compressor comprising a compressor base; a compression module adapted to be fixed to the base; and a compressor control device, such as a starter box, fixed to the base; where the compressor base includes means for moving the compressor starter box relative to the base, toward and away from the compression module while the compressor starter box is attached to the base.

The means for moving the attached starter box relative to the base includes a base plate, having a pair of slots that are adapted to receive at least one guide member that attaches the compressor starter box to the compressor base.

The foregoing and other aspects will become apparent from the following detailed description of the invention when considered in conjunction with the accompanying drawing figures.

BRIEF DESCRIPTION OF THE DRAWING FIGURES

Figure 4:
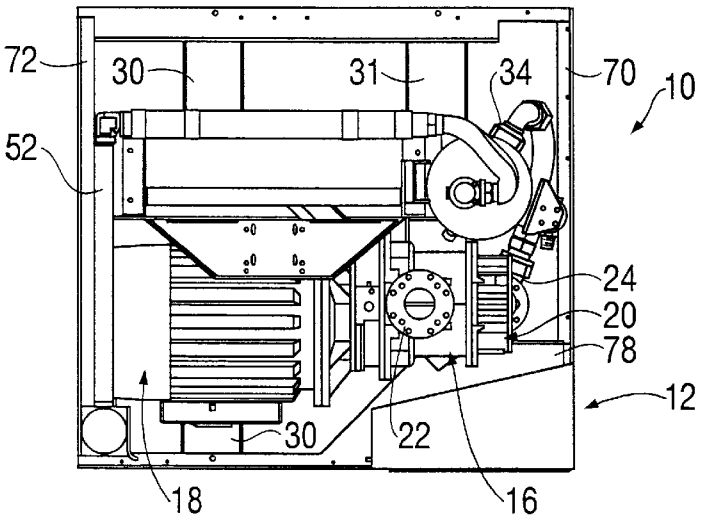
FIG. 4 is a top view of the fluid compressor of FIG. 1.
Figure 6A:
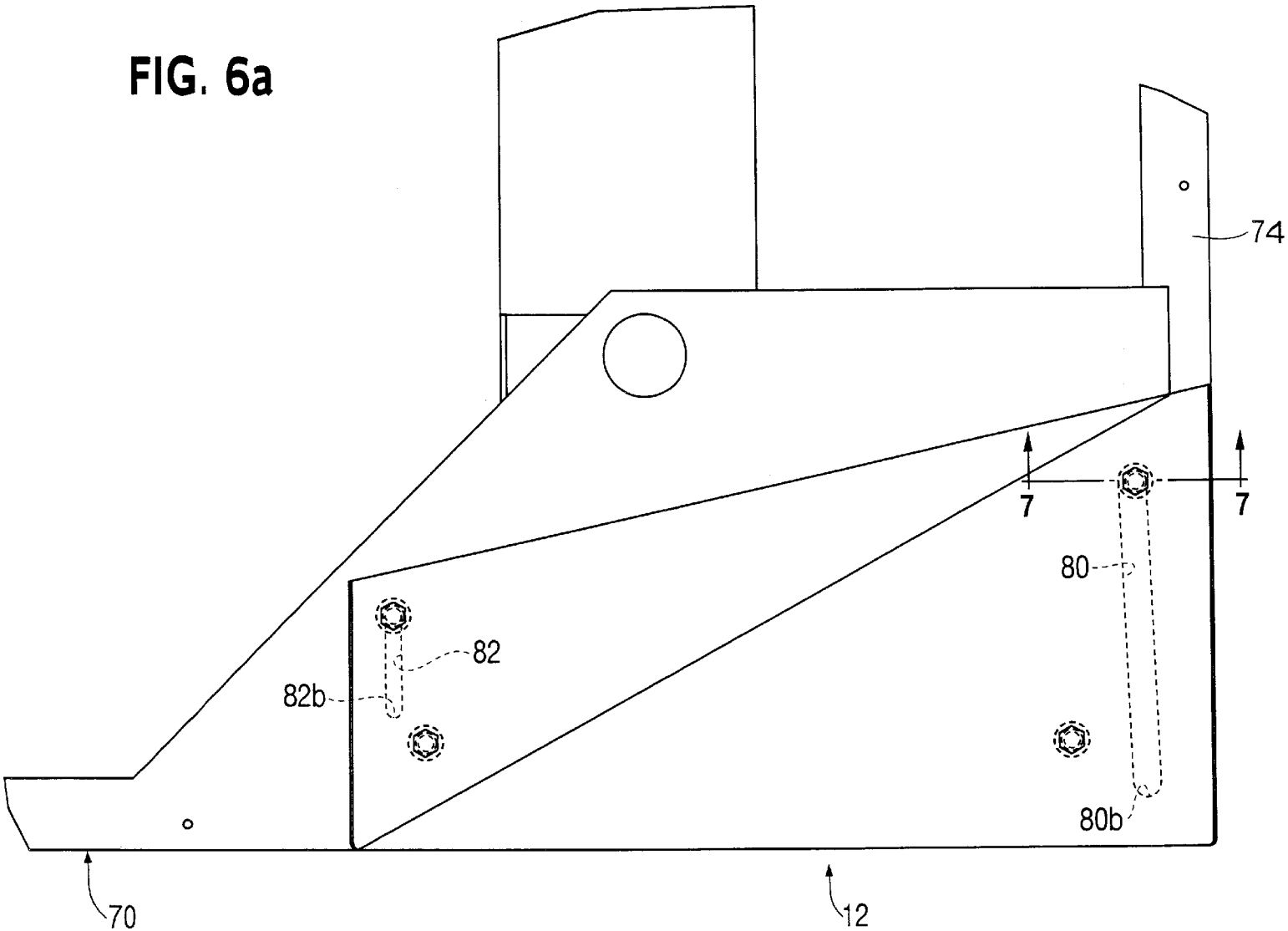
Figure 6B:
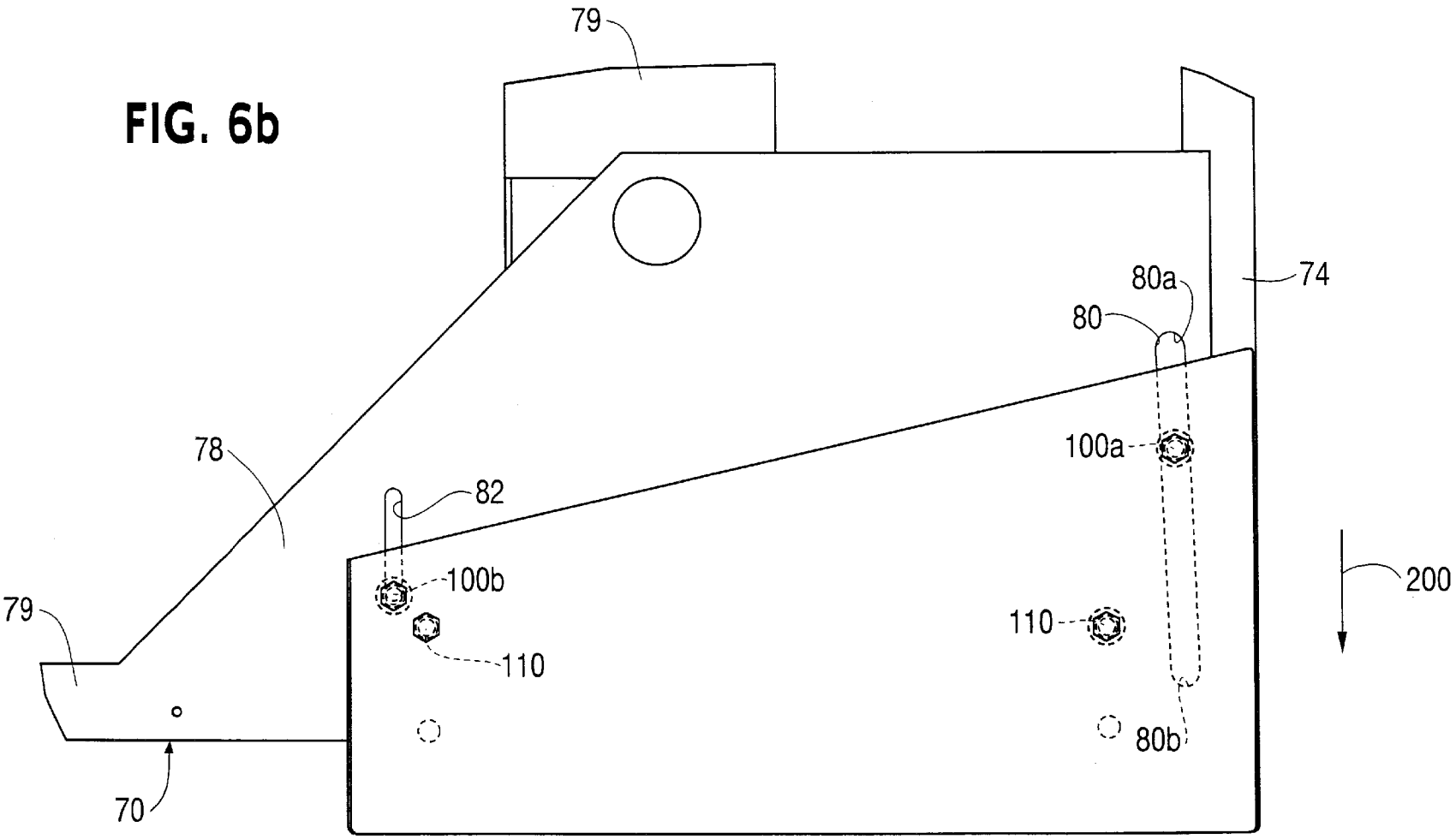
Figure 6C:
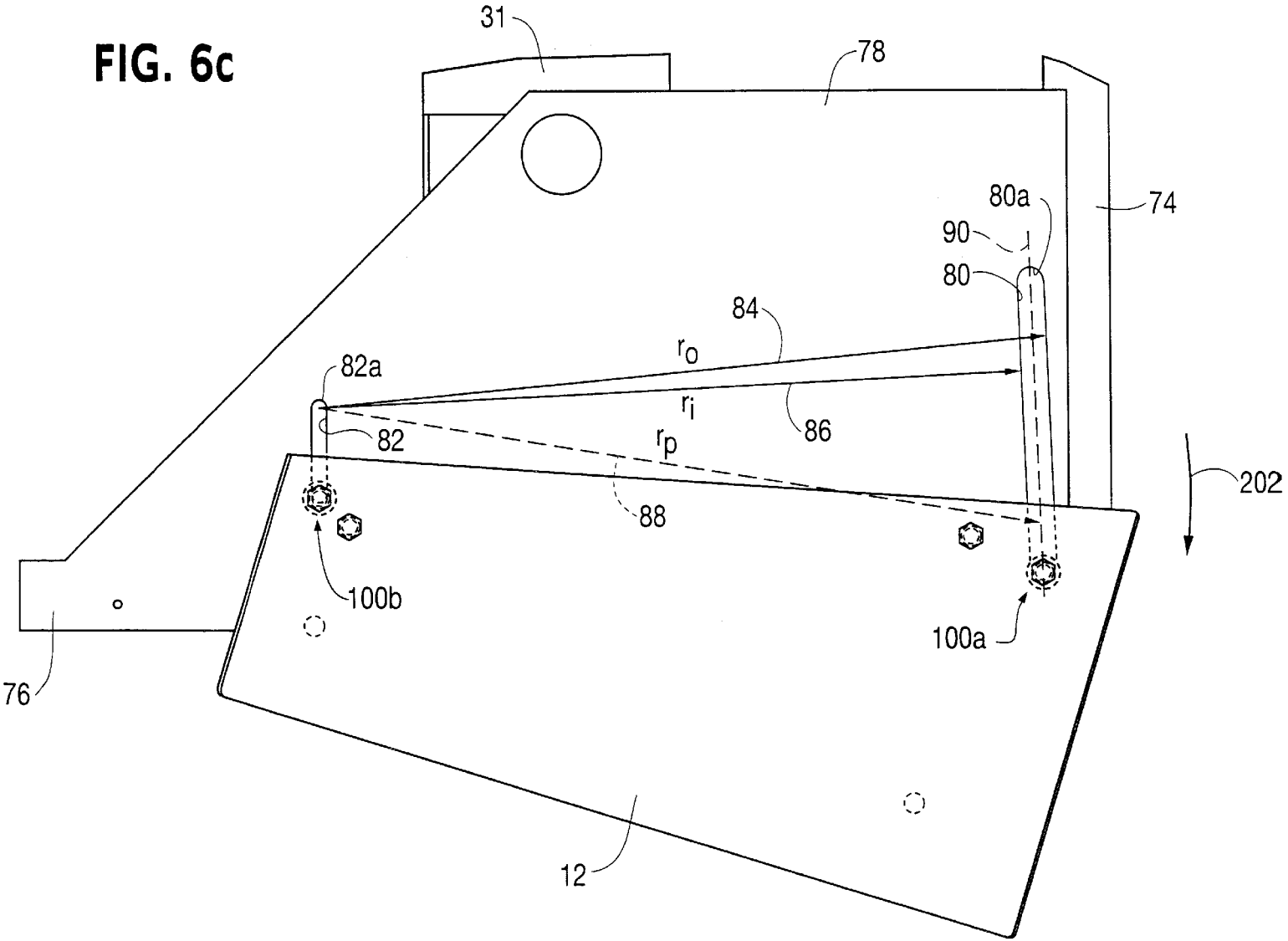
Figure 7:
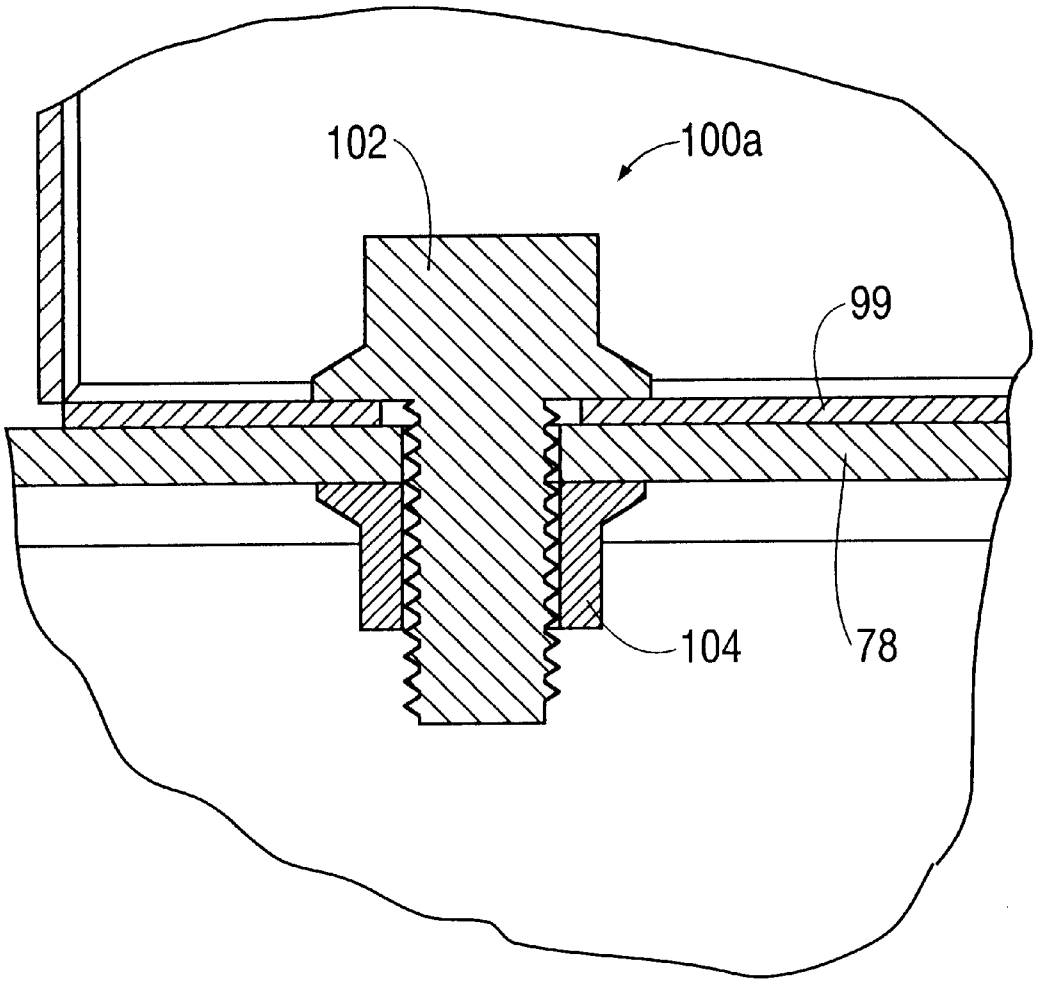

FIGS. 6*a*, 6*b*, and 6*c* are enlarged top views of the compressor starter box shown in FIGS. 4 with each Figure showing the compressor starter box in a different position relative to the compressor base and the compressor compression module; and FIG. 7 is a sectional view taken along line 7—7 of FIG. 6*a*.

DETAILED DESCRIPTION

Figure 1:
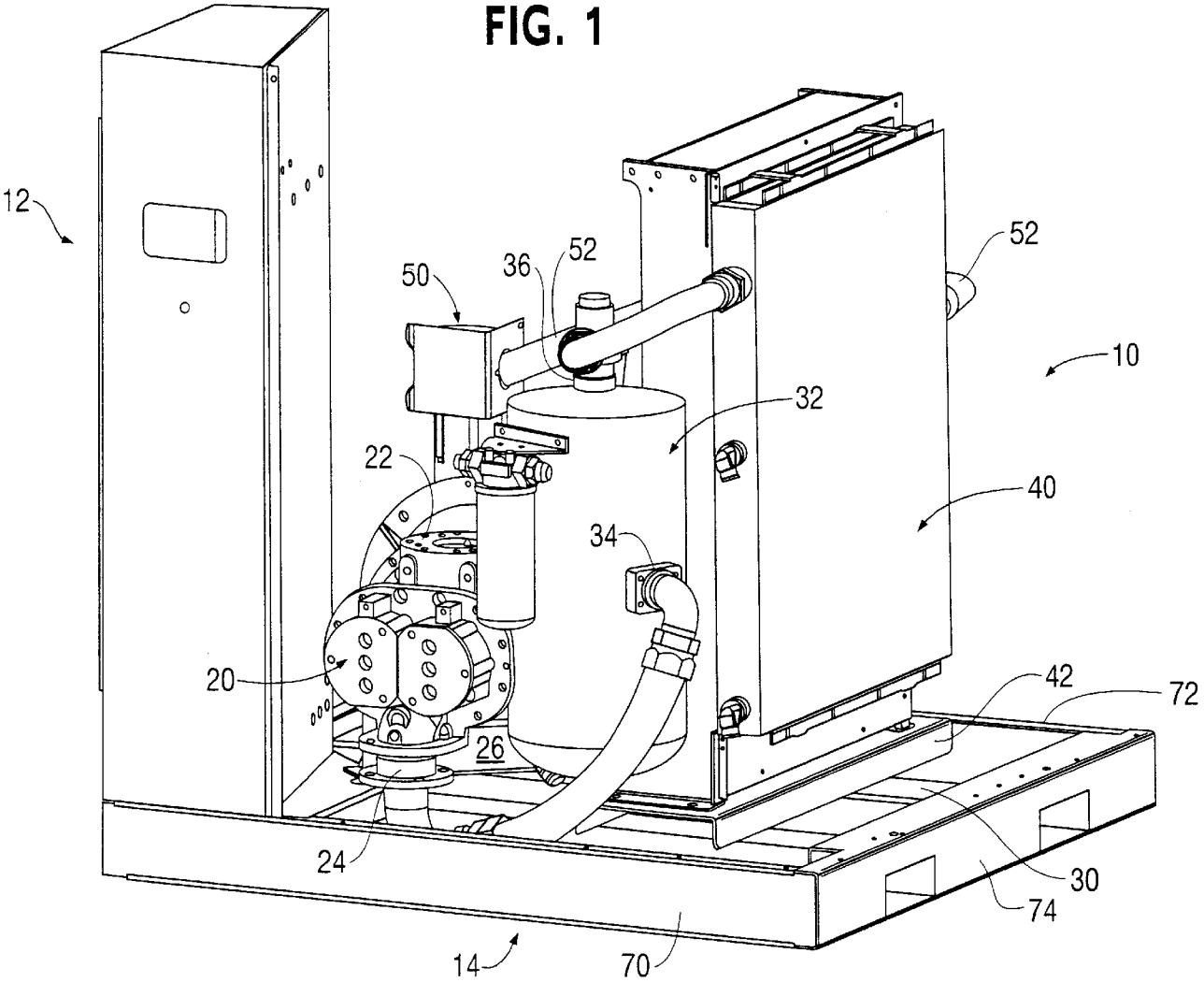
FIG. 1 is an isometric view of a fluid compressor that includes a movable compressor control device including a starter box of the present invention.

Now turning to the figures wherein like parts are referred to by the same numbers throughout the drawing figures, drawing FIG. 1 generally shows fluid compressor 10 that includes a movable compressor control device, such as starter box 12, of the present invention, which is movable relative to compressor base 14 toward and away from compressor airend 16 and prime mover 18 to permit the prime mover and airend to be removed from the base for repair or replacement through the front 70 of the compressor base.

FIGS. 1–5 shall be referenced for the initial portion of the detailed description. For purposes of describing the preferred embodiment of the invention, compressor 10 is a rotary screw compressor having an airend 16 that is comprised of interengaging male and female rotors (not shown) that are well known to one skilled in the art. The rotors are enclosed by airend housing 20 which includes an inlet 22 for flowing uncompressed fluid into the airend and a compressed fluid discharge port 24 for flowing the compressed fluid out of the airend. The airend is fixed to a rigid support beam 26 which in turn is fixed to base 14 by a conventional connection means.

Prime mover 18 which may be an electric motor for example, is operatively connected to the airend to drive the airend rotors. The prime mover is fixed to the frame support member 30. The airend and prime mover are fixed to the frame by conventional means such as bolt connection, weld connection or the like.

As shown in FIGS. 1–5, the airend discharge 24 is flow connected to the inlet 34 of conventional moisture separator 32. Liquid mixed with the compressed fluid is separated from the compressed fluid in a conventional manner by the moisture separator. The substantially liquid-free compressed fluid flows out of the moisture separator discharge 36 to after cooler 40 which cools the hot compressed fluid.

The after cooler 40 is fixed to frame support member 42 which overlays and is welded to frame member 30 and frame member 31. The separator 32 is hung from the aftercooler by conventional bracket connections 38.

The cooled compressed fluid is flowed from the aftercooler to moisture separator 50 through pipe 52 which flow connects the aftercooler discharge and the inlet of the separator. The separator removes condensed liquid from the cooled compressed fluid so that the compressed fluid that is supplied to an object of interest such as a pneumatic tool is liquid free.

Now turning to FIGS. 6*a*–6*c*, the compressor starter box 12 of the present invention which is movable relative to the frame 14 toward and away from airend 16 and prime mover 18 while being attached to the base, the starter box is of conventional design and as such, is adapted to house the electrical components such as switches, relays and microprocessors for monitoring operation of fluid compressor 10 and switching electrical components, such as prime mover 18, on and off. The interior chamber of the starter box is defined by sheet metal side, top and floor panels. The airend and prime mover are located inwardly of the starter box, separator 32 and aftercooler 40 as shown in FIG. 4.

Figure 2:
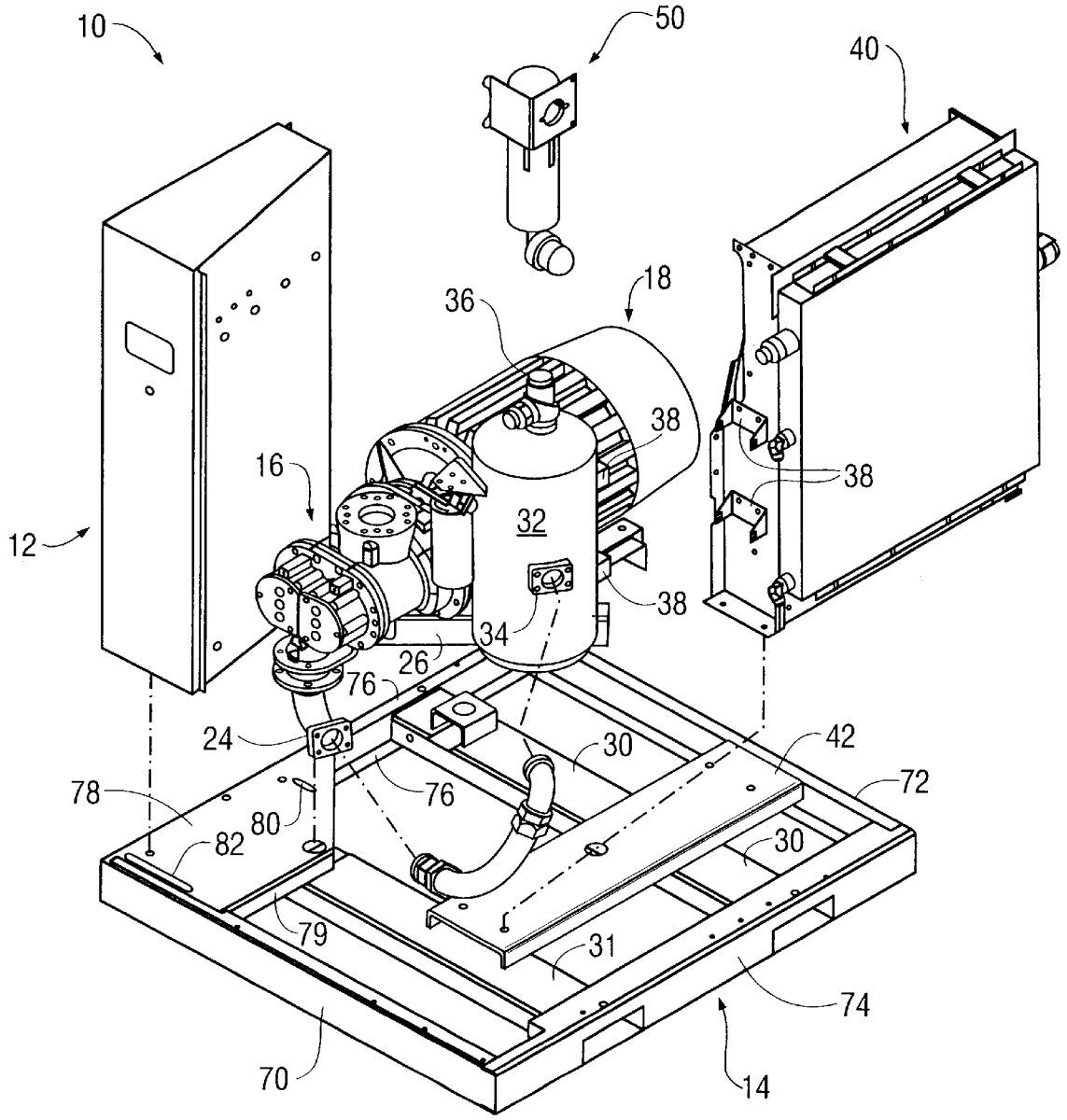
FIG. 2 is an exploded, isometric view of the fluid compressor of FIG. 1 with a number of the piping connections removed from the view.
Figure 3:
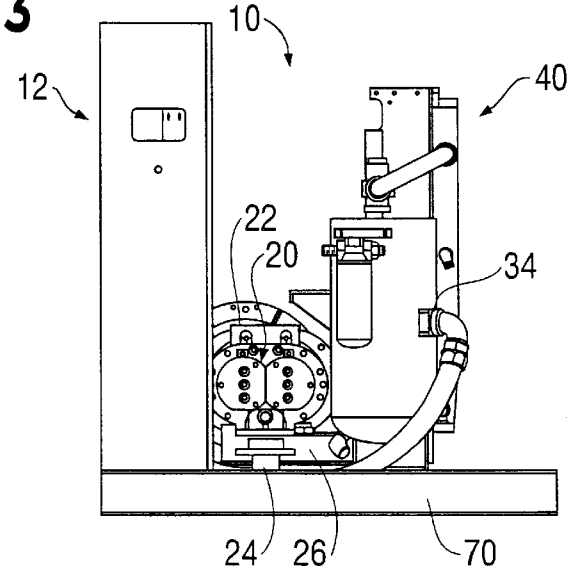
FIG. 3 is a front view of the fluid compressor of FIG. 1.
Figure 5:
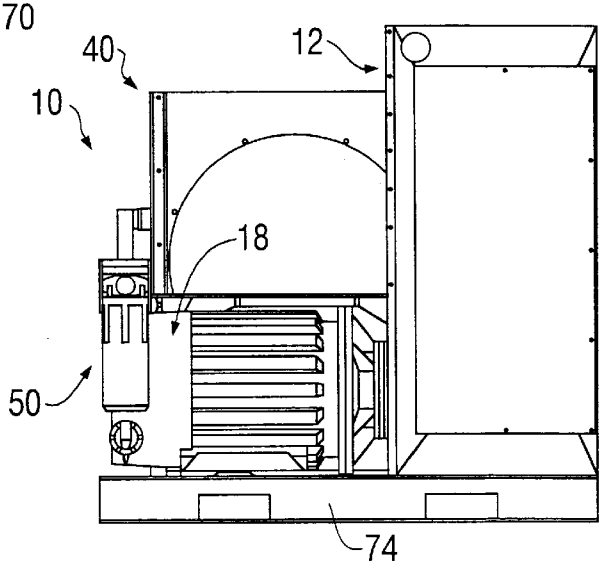
FIG. 5 is a left side view of the fluid compressor of FIG. 1.

Compressor frame or base 14, has a rectangular foot print or perimeter that is defined by front rail member 70, rear rail member 72, and side rails 74 and 76 which join the front and rear rails. The side rail members 74 and 76 are joined by frame support members 30 and 31 as shown in FIG. 2. The unitary side rail 76 includes starter box support plate 78 that is located along the top of the frame, perpendicular to rail member 76.

As shown in FIGS. 2 and 6*a*–6*c*, downturned support plate leg 79 which is perpendicular to plate 78 is fixed to the top of frame member 31, and the support plate is fixed to the top of front rail member 70. See FIGS. 2 and 6*a*–6*c*. The starter box support plate is substantially rectangular and as illustrated in the Figures.

Substantially parallel slots 80 and 82 are provided in starter box support plate 78. The slots are adapted to receive guide members 100*a* and 100*b* to attach the starter box to the support plate. In addition to guide members 100*a* and 100*b*, other connection members such as bolts, may be used to attach the starter box to the support plate. The guide members will be described in greater detail below.

Slot 82 has substantially straight linear longitudinal sides that are joined at the ends by arcuate sections 82*a* and 82*b*. Slot 80 has substantially arcuate longitudinal sides which are joined at the ends by arcuate sections 80*a* and 80*b*. The longitudinal sides of the slot 80 are defined by radii 84 and 86 which have their centers at the center of the arc comprising end section 82*a* of slot 82. See FIG. 6*c*. It should be understood that although two slots are shown and described, the starter box support plate should generally include at least two slots to cause the starter box 12 to be moved in the manner described below. Greater than two slots may be provided in the starter box support plate 78 if necessary.

As shown in FIG. 6*c*, the median arc 90 shown in dashed font between the longitudinal sides of slot 80 is defined by radius 88 which has the same center point as radii 84 and 86. The radii 84, 86, and 88 of the sides of slot 80 are centered at $r_c$ which is the located at the center of the arcuate end 82*a* of slot 82, as shown in FIG. 6*c*. The median arc 90 represents the path that is followed by first guide member 100*a* when the starter box is moved while attached to the frame by the guide members 100*a* and 100*b*.

Now turning to FIG. 7, as described above, the fluid compressor 10 includes two like guide members 100*a* and 100*b*. Each guide member is adapted to attach the starter box to the starter box support plate 78 as the guide member travels through the slots 80 and 82 during movement of the starter box. Guide member 100*a* travels through slot 80, and guide member 100*b* travels through slot 82. Since guide members 100*a* and 100*b* are the same, only guide member 100*a* will be described. Guide member 100*a* is comprised of a fastener 102, such as a bolt and a locking member 104 such as a nut, that is removably attached to the fastener. The sheet metal starter box floor panel 99 and starter box support plate 78 are clamped between the head of the fastener and the locking member, as illustrated in the sectional view of FIG. 7. During compressor operation, the nut is tightened against the plate 78, and when it is necessary to move the starter box, the nut for each guide member 100*a*, 100*b* is loosened.

Movement of the starter box will now be described using FIGS. 6*a*–6*c*. When it is necessary to move the starter box from its stationary position shown in FIG. 6*a*, any connection members attaching the starter box to the frame are first removed and the nuts of the guide members 100*a* and 100*b* are loosened. When the starter box is in its first position shown in FIG. 6*a*, one face of the starter box is coplanar with the side of rail member 76.

After loosening the guide member locking members 104, the starter box and guide members are moved linearly relative to frame 14, in the direction of arrow 200. The starter box and guide members are moved outward, away from airend 14 and prime mover 16 until the fastener 102 of guide member 100*b* is located in end 82*b* of slot 82 as shown in FIG. 6*b*. As the starter box is moved, the guide member 100*a* follows path 90 through slot 80. When the starter box is in this intermediate location shown in FIG. 6*b*, the fastener 102 of guide member 100*a* is located between slot ends 82*a* and 82*b*.

The starter box is then rotated clockwise about the center of the arc at the end 82*b* of slot 82, away from airend 14, in the direction of arrow 202. As the starter box is rotated, guide member 100*a* continues along path 90 until the fastener 102 of guide member 100*a* is located in the end 80*b* of slot 80, as shown in FIG. 6*c*.

When the starter box is moved to the position shown in FIG. 6*c* away from the compression module, a compressor technician can remove the airend and prime mover through the front 70 of the frame 14. Their removal can be made by one technician. It is not necessary to remove the starter box from the frame in order to remove the compression module. The starter box remains attached to the frame during the starter box movement described.

After servicing the prime mover and/or airend, the serviced component is returned to its fixed location on the frame, and the starter box is moved back to its initial position. The starter box is rotated clockwise about guide member 10*b*, and then the starter box and guide members are translated linearly towards the compression module until the fasteners 102 of the guide members are located in the ends 80*a*, and 80*b* of the slots 80 and 82. Then the locking members 104 are tightened and any other connection members are returned to reconnect the starter box to the frame.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A fluid compressor comprising a compressor base; a compression module adapted to be fixed to the base; and a compressor control device fixed to the base; said compressor base including means for moving the compressor control device toward and away from the compression module while the compressor control device is attached to the base, wherein said means for moving the compressor control device is comprised of a base support plate having a first slot and a second slot formed in the support plate, the first slot being longer than the second slot; and at least two guide members which are adapted to be moved through the slots and attach the compressor control device to the base during movement of the compressor control device.

2. The fluid compressor as claimed in claim 1, wherein the first slot has a radius of curvature centered at a location along the length of the second slot.

3. The fluid compressor as claimed in claim 2 wherein the second slot has an arcuate end, the center of the radius of curvature of the first slot being the center of the arcuate end.

4. The fluid compressor as claimed in claim 1 wherein the guide members each are comprised of a fastener member with a locking member attached to the fastener member.

5. The fluid compressor as claimed in claim 1 wherein the compression module is comprised of a rotary screw airend and an electric motor.

6. The fluid compressor as claimed in claim 1 wherein the first slot has arcuate longitudinal sides joined by arcuate ends; the second slot has straight longitudinal sides joined by arcuate ends; each of the arcuate longitudinal sides of the first slot having a radius of curvature that is centered at an end of the second slot.

7. In a fluid compressor comprising a compression module fixed to a compressor base, and a compressor control device movably attached to the base, the method comprising the step of moving the compressor control device relative to the base away from the compression module while remaining attached to the base, and wherein movement of the compressor control device is comprised of the step of translating the compressor control device away from the compression module and rotating the compressor control device away from the compression module.

8. The method as claimed in claim 7 wherein the compressor base includes a compressor control device support plate with a first slot, and a second slot; the compressor further comprising a pair of guide members which attach the compressor control device to the support plate and are adapted to be moved through the slots, the method comprising the steps of translating the compressor control device and one of the guide members away from the compression module, and then rotating the compressor control device and the other guide member about the one of the guide members further away from the compression module.

9. The method as claimed in claim 8 wherein the slots terminate at ends, the starter box and guide members being translated until one of the guide members is moved to the slot end, the starter box and guide member being rotated until the other guide member is located at its end.

* * * * *